United States Patent [19]

Vogen

[11] Patent Number: 4,674,571

[45] **Date of Patent: * Jun. 23, 1987**

[54] METHOD AND APPARATUS FOR IMPROVING OIL PRODUCTION IN OIL WELLS

[75] Inventor: Wayne V. Vogen, Oakland, Calif.

[73] Assignee: URS Corporation, San Mateo, Calif.

[ * ] Notice: The portion of the term of this patent subsequent to Mar. 11, 2003 has been disclaimed.

[21] Appl. No.: 788,012

[22] Filed: Oct. 16, 1985

Related U.S. Application Data

[63] Continuation-in-part of Ser. No. 637,385, Aug. 2, 1984, Pat. No. 4,574,888.

[51] Int. Cl.[4] ..... E21B 43/25

[52] U.S. Cl. ..... 166/249; 166/177

[58] Field of Search ..... 166/249, 53, 177, 369, 166/65.1

[56] References Cited

U.S. PATENT DOCUMENTS

| | | | |
|---|---|---|---|
| 2,700,422 | 1/1955 | Bodine, Jr. | 166/177 |
| 3,004,389 | 10/1961 | Muller | 175/56 |
| 3,189,536 | 6/1965 | Bodine, Jr. | 166/249 |
| 3,262,507 | 7/1966 | Hansen | 175/56 |
| 4,342,364 | 8/1982 | Bodine | 166/249 |
| 4,512,402 | 4/1985 | Kompanek et al. | 166/249 |

*Primary Examiner*—Stephen J. Novosad
*Assistant Examiner*—Hoang C. Dang
*Attorney, Agent, or Firm*—Owen, Wickersham & Erickson

[57] ABSTRACT

Method and apparatus for improving oil production in oil wells. The lower end of an elastic steel column is attached to the upper end of a liner. The upper end of the column extends above the top of the well and is attached to a reaction mass lying vertically thereabove through (1) an accelerometer and (2) vertically mounted compression springs in parallel with a vertically mounted servo-controlled hydraulic cylinder-piston assembly. A substantially constant upward load is applied to the reaction mass, and the piston of the hydraulic assembly is reciprocated under servo control to apply vertical vibration to the upper end of the column. This vertical vibration is adjusted through the servo control to an appropriate resonant frequency for the column in the range of 5 Hz to 25 Hz, and the frequency is maintained at resonance by a feedback system relying on maintaining a phase difference of 90° between a displacement signal developed from the accelerometer and a pressure-differential signal related to the pressure difference between the opposite sides of the piston.

13 Claims, 8 Drawing Figures

METHOD AND APPARATUS FOR IMPROVING OIL PRODUCTION IN OIL WELLS

This invention relates to method and apparatus for improving the production of oil from some types of oil wells.

REFERENCE TO RELATED APPLICATION

This application is a continuation-in-part of application Ser. No. 637,385, filed Aug. 2, 1984, now U.S. Pat. No. 4,574,888, issued Mar. 11, 1986, which was a continuation-in-part of application Ser. No. 505,254, filed June 17, 1983 and now abandoned.

BACKGROUND OF THE INVENTION

Oil wells eventually become depleted and little more can be pumped from them. Production drops to a marginal amount or below that. Under these circumstances, it is conventional to withdraw such equipment as is salvageable and then to plug the well and abandon it.

The decrease in production may be due to actual substantial depletion of the oil in the oil bearing stratum or strata or to plugging of the perforations of the liner through which oil is drawn into the tubing and pumped from the well. Sometimes, steam has been forced down through the tubing and liner, and production has then increased for a while and then decreased again. The additional production has been worth the expense involved, even though the oil production may have been increased only for a month or two.

I have discovered a new method for increasing oil production from old oil wells that appear to be substantially exhausted, even after steam treatment has been tried. This method may not work for every type of oil well or for every type of oil bearing strata, but it has succeeded under certain circumstances and may well be applicable to others.

The invention, as discussed below uses particular techniques involving cyclic vibration. Such techniques are to be differentiated from the different techniques recommended by various early patents, mainly those of Albert G. Bodine. Mr. Bodine has been active in proposing the stimulation of wells by vibration for quite a long time; his first U.S. Pat. No. 2,437,456 was applied for in 1941. Bodine U.S. Pat. No. Re. 23,381 of 1951 cites 50 Hertz as an appropriate frequency. He also proposed vibrating the tubing with the liner attached and proposed that adjacent wells can be stimulated.

Bodine's U.S. Pat. No. 2,667,932 of 1954 included the use of counter-rotating masses for the excitation of the pipe string. Also Bodine proposed to anchor the bottom of the pipe to the oil bearing region. His patent states that exciting the bottom of a casing which has been cut just above the oil bearing region is one way to couple the surface-produced vibration to the oil bearing region. He also appreciated that "The means for generating these vibrations may be mechanical, electrical, hydraulic . . . "; an effective frequency range is stated to be 10 to 30 Hertz. He also appreciated that "a column having heavy mass and large area in contact with the formation" (liner) is important to the efficient transmission of energy to the formation. He alludes to, but does not include in his claims, the importance of the column of fluid in the well. This column helps to overcome the pressure caused by the overburden.

Bodine's U.S. Pat. No. 2,680,485, 1954, employed a vibrator at the surface attached to tubing which was in turn firmly attached to a perforated liner at the bottom of the well. This whole system was excited in tension and compression by the surface vibrator.

Bodine's U.S. Pat. No. 2,700,422, 1955, seems to embody the disclosure of all of his previous patents concerning stimulation and pumping of oil wells.

Bodine's U.S. Pat. No. 2,871,943, 1959, describes a down hole vibrator which was claimed to be powerful enough to fracture the formation and decrease the permeability, as opposed to merely stimulating oil production.

His U.S. Pat. No. 3,016,093; 1062, describes the generation of asymmetrical pressure waves, as opposed to the sinusoidal type of waves that the present invention produces.

Resonant dynamic excitation offers significant advantages. However, in a system which is controlled by the power input (e.g., the rotational speed of an engine), a potential "runaway" situation exists, for when the maximum power input for a particular resonance is exceeded, the engine may speed up greatly, because the pipe can absorb less power at a frequency higher than resonance. This problem will be explained below in more detail.

Another potential problem is that of exciting harmful modes of vibration of the derrick. Modes of vibration which have a lower resonant frequency than the desired mode and which involve different parts of the derrick and support structure, have large and potentially harmful vibrational amplitudes. A system which increases the operating frequency to arrive at the desired mode tends to excite these harmful modes and create hazardous conditions.

Among the objects of the invention are these: to provide a practical and economic method for stimulating oil production; to keep the drill pipe or string at resonance when and if the resonant frequency changes; to provide for relatively low power operation; and to provide controls that protect the apparatus from damaging itself.

SUMMARY OF THE INVENTION

The invention has both method and apparatus aspects, both similar, in part, to those disclosed by my co-pending patent application, Ser. No. 637,385, filed Aug. 2, 1984 now U.S. Pat. No. 4,574,888, issued Mar. 11, 1986.

The method of the invention relates to stimulating an increase in oil production from an oil well. It begins by attaching the lower end of an elastic steel column to the upper end of a liner or the like. The upper end of the column extends to and above the top of the well. To this upper end of the column is attached a reaction mass vertically thereabove, the attachment being made through a vertically mounted servo-controlled hydraulic cylinder-piston assembly.

The method next calls for reciprocating the piston of the hydraulic cylinder under servo control to apply vertical vibration to the upper end of the column. This vertical vibration is continually adjusted through the servo control to an appropriate resonant frequency for the column, in the range of 5 Hz to 25 Hz, the resonance being maintained by the application of electrical feedback from an accelerometer rigidly connected to the top of the column. A displacement signal is produced by double integration of a signal from the accelerometer.

The apparatus includes a reaction mass, vertically mounted compression springs, and, in parallel with the springs, a vertically mounted hydraulic cylinder-piston assembly which connects the reaction mass to the column.

A servo-control system for the hydraulic cylinder-piston assembly simultaneously reciprocates the piston to apply vertical vibration to the upper end of the column, and feedback apparatus continually adjusts the servo-control to cause the assembly to seek and maintain an appropriate resonant frequency for the column, in the range of 5 Hz to 25 Hz.

The present invention provides means for keeping exactly on resonance, thereby producing the maximum response at the liner for a given amount of power. This is important, because any other system would have to be larger than that of present invention in order to be as effective. The unit of the invention occupies a large truck and employs a rather large engine. Using a servo hydraulic actuator provides infinitely variable controllability. A well whose production was increased from 20 to 200 barrels of oil per day was vibrated at different levels ranging from one inch to 5½ inches peak to peak at 10 Hertz. At the present time it is not clear what level or combination of levels of vibration is responsible for the increased production, but further experience will delineate the formula for excitation level and duration required to maximize the production from a particular well. The unit's efficiency and fine controllability make it superior in this application. These factors result in much higher excitation levels being attainable than with other known devices.

Shaking a liner to stimulate increased oil production is fundamentally different from extracting stuck liners. The dynamic operating conditions to not change during the stimulation process. When a liner is being removed, the operating conditions change during the whole process. The unstuck length becomes longer as more power is applied, resulting in a decrease in the resonant frequency. When the operating frequency coincides with a lateral mode of vibration of the pipe, the shaking at the top of the drill pipe causes harmful lateral modes of vibration of the drill pipe to get excited, necessitating the use of drill pipe protectors. The drill pipe protectors create nodes in the pipe which eliminate modes of vibration in the operating frequency range. The protectors are necessary because the changing conditions guarantee that the operating frequency will come close to the frequency of a lateral mode and excite it, stopping the desired longitudinal shaking.

Since the mode of operation used to stimulate oil production is constant, system parameters can be adjusted to avoid harmful lateral modes, thereby eliminating the need for the node creating devices. This speeds the process and lowers the cost. This benefit is only realizable because the unit operates as a constant speed device in this application. Other devices employed for this purpose, such as ones utilizing counter rotating masses, must sweep through the frequencies of these deleterious lateral modes, necessitating the use of node producing devices.

The technique used to avoid harmful lateral modes of vibration derive from the factors which cause the lateral modes. The frequencies of the longitudinal modes are proportional to the free length of the drill pipe and liner. The frequencies of the lateral modes of vibration are proportional to the static tension in the drill pipe and liner and the density of the string which is being vibrated. The density does not vary during a particular job, consequently only the tension need be controlled to achieve elimination of lateral modes of vibration. The procedure employed simply involves choosing a suitable longitudinal mode of vibration and locking the resonant controller onto the mode at a low level of vibration. If a lateral mode starts to become excited, as can easily be detected by observing the sideways motion of the top of the drill pipe, the static pull applied by the workover rig is changed until the lateral mode shows no tendency to develop. The liner can then be vibrated for the amount of time required to increase the production rate of the well.

Other features of the invention, as well as other objects and advantages will be described below.

DESCRIPTION OF A PREFERRED EMBODIMENT

Figure 1:
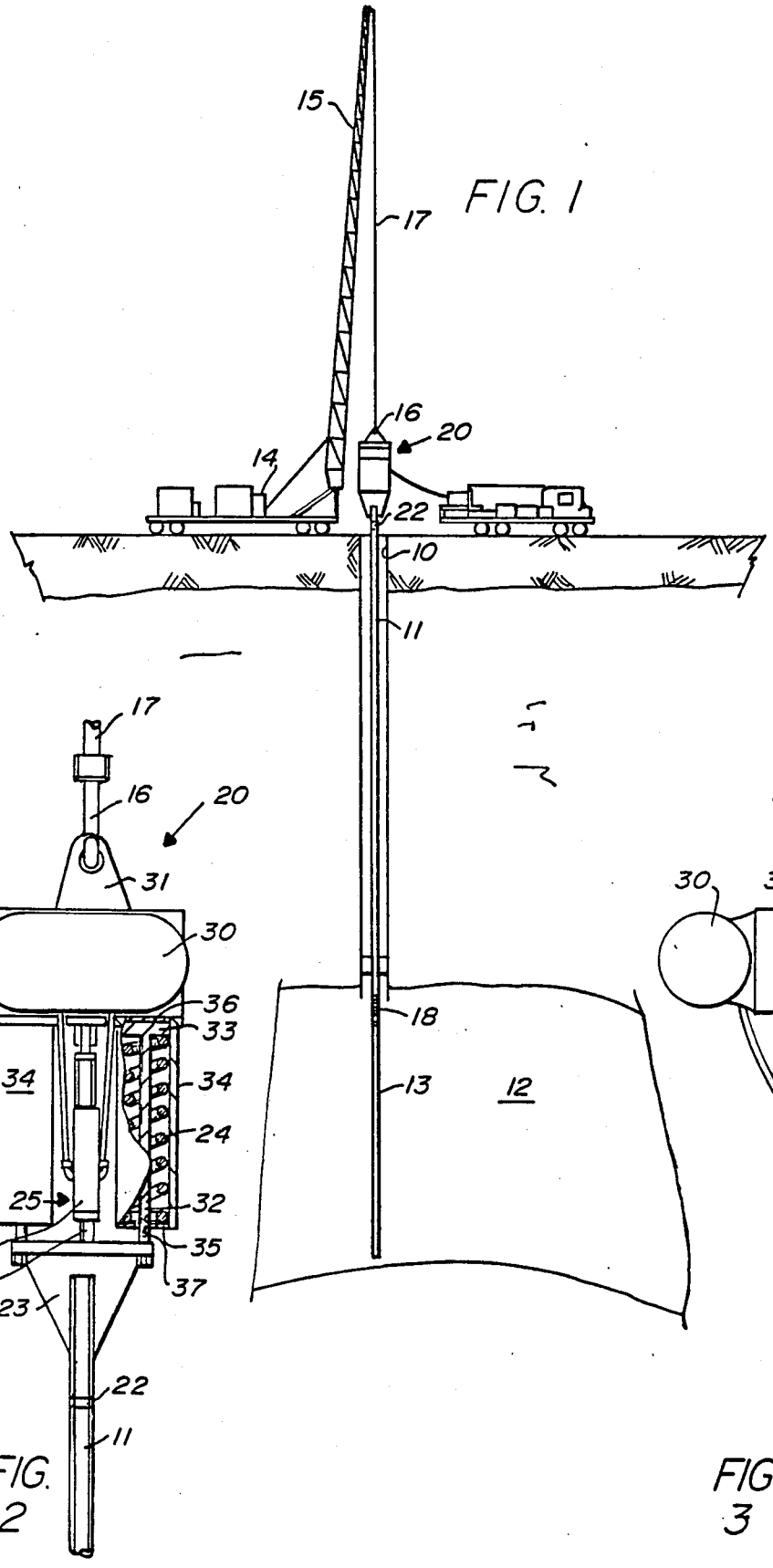
FIG. 1 is a simplified view in elevation and in section of apparatus embodying the principles of this invention.

FIG. 1 shows an oil well 10 with a pipe, i.e., a drill line 11, leading down to a deposit 12 of oil sand, in which is a liner 13. According to the present invention, a typical procedure for increasing oil production includes setting up a well workover rig 14 including a suitable derrick 15 with a shackle or block or hook 16 suspended on a cable 17, and attaching the appropriate pipe or drill string 11 to the liner 13 by means of a conventional fishing tool 18. Then a shaker or vibrator system 20 is attached to the top of the drill string 11.

Figure 2:
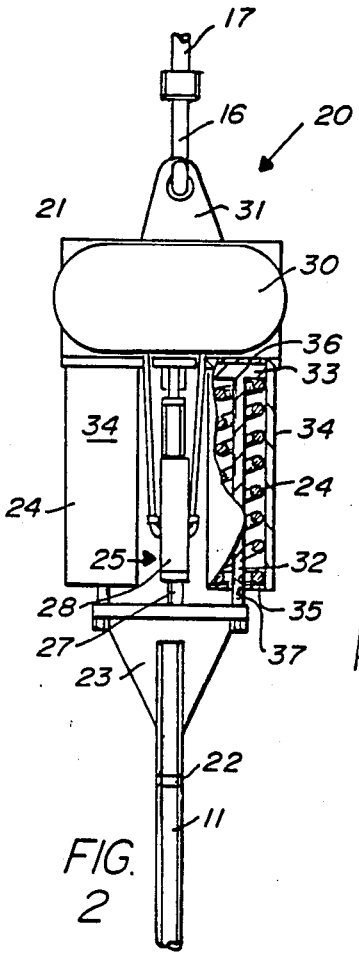
FIG. 2 is a fragmentary enlarged view in front elevation of the vibratory apparatus of FIG. 1 connecting the top of the drill rod to a reaction mass.
Figure 3:
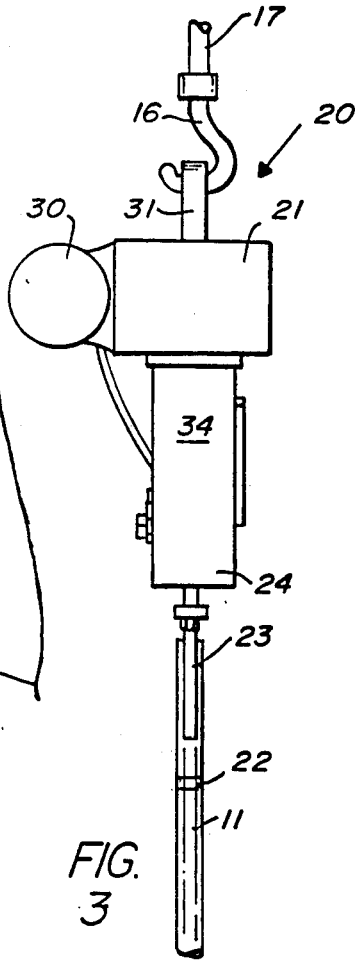
FIG. 3 is a view in side elevation of the assembly of FIG. 2.

The shaker system 20, shown in more detail in FIGS. 2 and 3, includes a reaction mass 21 held by the hook 16 (or a conventional shackle).

The upper end of the drill string 11 is connected, as by a fitting 22, threaded or clamped to engage the threads at the upper end of the drill string 11, to a junction plate 23. A set of compression springs 24 form a connection between the junction plate 23 and the reaction mass 21, in parallel with a hydraulic cylinder-piston assembly 25, in which the piston 26 may be connected by a rod 27 to the junction plate 23, while the cylinder 28 is connected to the reaction mass 21.

An accumulator 30 is secured to and becomes part of the reaction mass 21, providing additional mass. The main reaction mass 21 may be a thick steel box filled with lead bricks and having a lifting eye 31 for attachment to the hook 16. The reaction mass 21 thus provides a nearly rigid structure for the hydraulic assembly 25 to work against. In addition, it greatly attenuates the motion imparted to the drill pipe 11 so as effectively to isolate the well derrick 15 from the large movements provided by the hydraulic cylinder-piston assembly 25.

The springs 24 are connected in parallel with the hydraulic assembly 25 to support the static load of the weight of the drill string 11 and the pull exerted by the derrick 15 through the lifting block 16. The springs 24 are preferably flat-end compression springs, each of which has a rod 32 through its center terminating at a bearing plate 33, so that the springs 24 behave like extension springs. The spring 24, rod 32, and bearing 33 are contained in a steel tube 34 with a lower end 35 against which the spring 24 bears, and the upper end 36 of the tube 34 is connected to the bottom of the reactions mass 21. The rod 32 extends out through an opening provided with a bearing 37 in the lower end 35 of the tube 34 and is connected to the junction plate 23.

The springs 24 are sized with respect to length and stiffness so as to be at or near mid-deflecton under the range of the static loads to be encountered. The static load is generally the combination of the weight of the drill pipe 11 in the hole and the pull exerted by the rig 14 on the shaker system 20. The upward pull exerted by the workover rig 14 assures that the elastic pipe column 11 will always be in tension, thereby preventing Euler buckling of the drill string 11.

Figure 4:
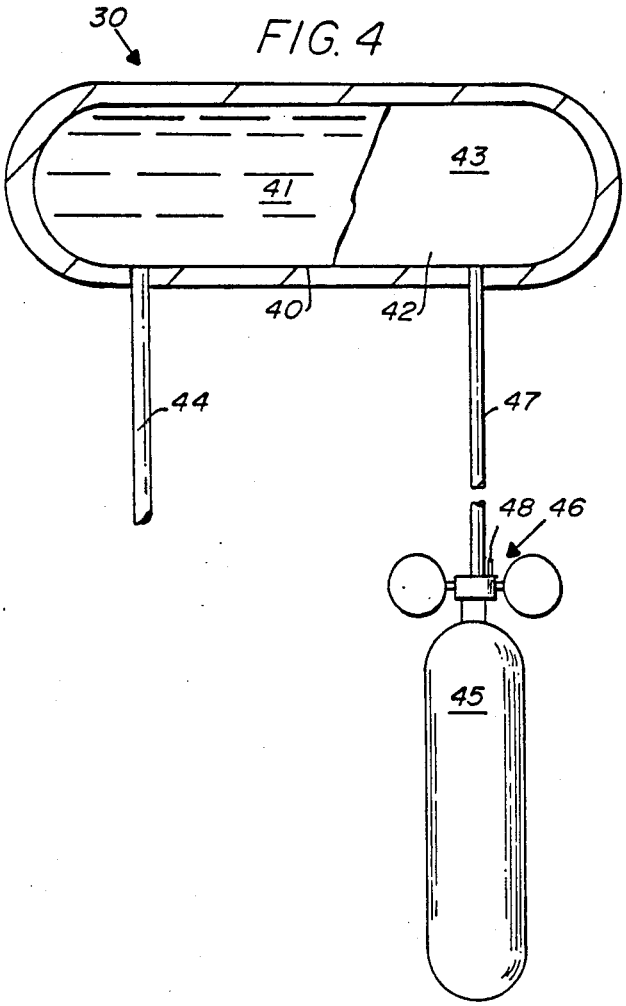
FIG. 4 is a view in elevation and partly in section of the accumulator of FIGS. 2 and 3 and its related parts, through which sharp pulses and high level transient boosts in output power may be applied to the drill rod of FIG. 3.

During the set-up period, a hydraulic pump 80 (FIG. 6) is operated to store pressurized hydraulic fluid in the accumulator 30 at about 3000 p.s.i. The hydraulic accumulator 30 is a pressure vessel which contains a piston or inner expandable container 40 for hydraulic fluid 41 and an outer container or bladder 42 filled with nitrogen gas. As shown in FIG. 4, the accumulator 30 has a conduit 44 leading from the bag 40 to the hydraulic cylinder 28. The bladder 42 is supplied with nitrogen gas 43, when desired, by a high-pressure (e.g. 5,000 p.s.i.) nitrogen supply cylinder 45, via a regulator 46 and a conduit 47. A bleed valve 48 is provided to relieve the pressure in the bladder 42 as desired.

The accumulator 30 serves two main purposes. First, it reduces the pressure drop caused by the flexiblity of the supply hose 44 which leads from the hydraulic pump 80 to the hydraulic cylinder 28. Second, it provides an energy storage medium in which high-pressure hydraulic fluid 41 can be accumulated (hence its name) before the commencement of excitation of the drill pipe 11.

After pressurization of the accumulator 30, the shaker 20 may be actuated and driven (by apparatus to be described below) at a power level which can cause significant heating in the uppermost portion of the bound liner 13. This level of vibration supplies considerable longitudinal and radial motion that apparently tends to excite additional flow of petroleum to the liner.

Recently the invention was employed at an oil well which had an estimated potential for producing 130 bpd. (barrels per day) of oil but was producing only 20 bpd. The total depth of the well was 1360 feet. The liner interval ranged from a depth of 1125 feet to 1360 feet. The outside diameter was 7 inches. The 8⅝ casing overlapped the liner by 20 feet and was fitted with a lead seal adapter.

Vibration was applied for a period exceeding 2 hours at a frequency of 10 Hertz. The static load applied by the workover rig varied from 50,000 pounds to 90,000 pounds. The dynamic motion of the top of the drill string ranged from 1 inch peak-to-peak to 4.2 inches peak-to-peak for various lengths of time. During short bursts of approximately 10 seconds the amplitude exceeded 5 inches. At this time it is not known exactly what combination of excitation level and time is required to produce stimulation of an oil well, but it is known that after the treatment described, pumping was resumed and produced 200 barrels per day—10 times the previous production over a period of at least 30 days. In addition, the well has produced more than 170 barrels per day for an additional three months. The effect most probably includes a cleaning of the perforations in the liner by the vibratory action. There could also be other benefits which actually stimulate oil flow in the oil bearing strata.

An important feature of this invention is that the drill pipe 11 is driven at resonance by a servo-hydraulic system 25, operated in a feedback control mode. This is the most practical and economic method known to the inventor for accomplishing the needed resonant drive. Feedback control guarantees that the system is always driven exactly at resonance, thereby producing the maximum force.

Servo-controlled hydraulic cylinders are used in large numbers in numerous industries, unrelated to the present field, so that low cost, high reliability, and accuracy are readily obtainable. Therefore, the present system can be less expensive and more reliable and accurate than other possible methods of exciting the pipe 11 connected to the liner 13. Servo-controlled hydraulic cylinders are primarily used in a resonant configuration for material testing, where the benefit of resonance decreases the power and size of the actuator required to achieve a large number of stress cycles in the object under test. They have not been used heretofore in a system like that of this invention.

Because the frequency of excitation of a servo-hydraulic system is locked to the resonant frequency of the pipe, changes in the amount of applied power changes only the force at the bound position.

Figure 5:
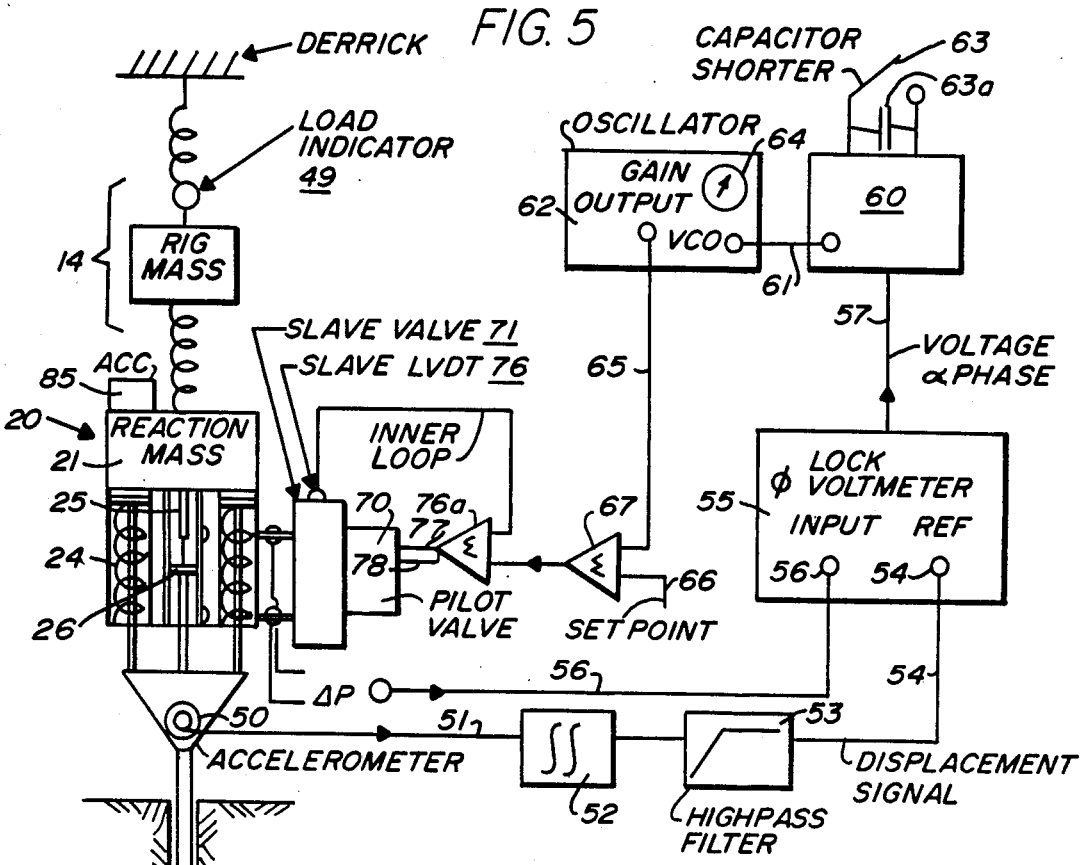
FIG. 5 is a block diagram of the servo-control and feedback system utilized to seek and maintain resonance.
Figure 5:
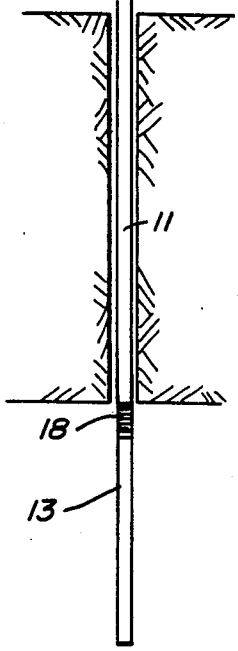

FIG. 5 shows, somewhat diagrammatically, a controller or control system that may be employed to maintain the elastic pipe 11 and the free portoin of the liner 13 in longitudinal resonance. An accelerometer 50 is attached to the top of the elastic column 11 to measure the acceleraton as referenced to ground 12, rather than to the reaction mass 21. The acceleration signal 51 from the accelerometer 50 is subsequently double-integrated electrically by a double integrator 52 and then filtered with a five-pole high-pass filter 53 to attenuate low frequency 1 by f noise. The 5-pole filter rolloff characteristic is down 5 db at 5 Hz. The resulting displacement signal 54 is very regular and is free from low-frequency noise. Other means of obtaining such a displacement signal which relates to the acceleration of the reaction mass 21 relative to the earth in which the well 10 is located, may be used, if desired.

The displacement signal 54 is used as the reference in a phaselock voltmeter 55 which detects the relative phase between a signal indicating pressure differential, P, across the hydraulic cylinder-piston assembly 26, put into the voltmeter 55 as a signal 56 and the displacement signal 54. The P signal 56 is a relatively pure sine wave during operation, but various factors such as the limited hydraulic supply pressure and pressure spikes distort the P signal 56. At resonance, the displacement signal 54 and the P signal 55 are 90° out of phase. The phaselock voltmeter 55 puts out a voltage 57 proportional to the relative phase between the displacement signal 54 and the P signal 56. The voltage 57 is zero when the relative phase is 90°. The voltage 57 increases when the phase becomes greater than 90° and decreases when the phase is less than 90°. The phaselock voltmeter 55 has the ability to extract the sine wave component at the operating resonant frequency of the displacement and P signals.

The voltage 57 is then sent to an integrator 60 and is electrically integrated. The output 61 of the intergrator 60 is used as the voltage-controlled oscillator (VCO) drive of a sine wave generator 62. The dc voltage output 61 of the integrator changes the frequency of the sine wave generator 62 to maintain resonance.

The integrator 60 may be an operational amplifier with a capacitor feedback loop, and in this invention a switch 63 is placed across a capacitor 63*a* of the integrator 60 so that the capacitor 63*a* can be shorted, thereby causing the output of the integrator 60 to be set to zero, as when setting the frequency of the oscillator 62 at the calculated resonant frequency for the drill string. A gain knob 64 of the oscillator 62 is used to control the amplitude of vibration of the elastic column 11 plus the freed portion of the liner 13. Turning up the gain proportionally increases the sine wave output signal 65 of the oscillator 62. This signal 65 is added to a d.c. voltage 66 at a voltage summing device 67. The voltage 66 is called the set point and controls the neutral position of a pilot servo valve 70. The pilot valve 70 may have a spool which is maintained approximately in its central position in order to keep the pressure wave across the hydraulic cylinder 25 symmetrical.

Figure 6:
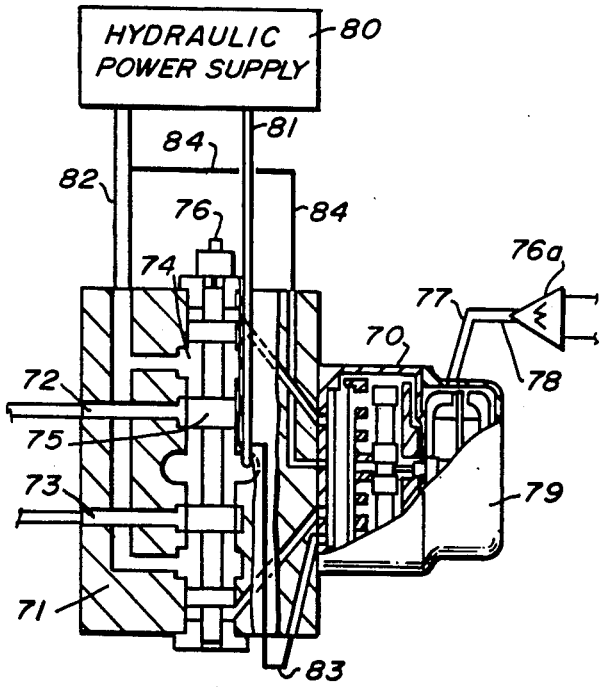
FIG. 6 is an enlarged diagrammatic view of a portion of FIG. 5, representing a slave system and related members.

FIG. 6 shows a slave valve 71 connected by ports 72 and 73 to the piston-cylinder assembly 25, these ports leading into a valve passage 74 in which a spool 75 moves, as determined by a slave LVDT 76. An adder or summing device 76*a* is connected to the summing device 67 and adds the signal from the valve 71 to that of the device 67. The output of the adder 76*a* is sent by lines 77 and 78 to control a motor 79 which operates the pilot valve 70.

There is a hydraulic power supply 80 to supply fluid to the slave valve 71 via a conduit 81 and to receive fluid via a conduit 82. A pilot pressure conduit 83 is connected to the conduit 81, and a pilot return conduit is connected to the conduit 84.

The neutral operating position in the system is controlled by the rig operator and is maintained by keeping the tension constant by either raising or lowering the lifting block of the rig 14. The constant tension keeps the springs 24, which are parallel with the hydraulic cylinder 25, at a constant neutral position. The control system of FIG. 5 maintains the frequency precisely at resonance and the phase at 90°±1°.

I have found that previously available resonant control loops were not capable of maintaining the elastic column in a resonant condition. Previous systems employed an LVDT to derive an electrical signal proportional to relative displacement between the reaction mass 21 and the top of the elastic column. This system is appropriate when the reaction mass 21 is replaced by a rigid attachment to ground, but in my apparatus, the control system would amplify undesirable modes of vibration involving the rig 14 used to hold the vibrator.

The low-frequency position feedback of the normal control loop has been eliminated, because it counteracted the rig operator and effectively pushed the elastic column back down into the oil well 10.

When the standard resonant control scheme was employed, such as one which utilized a zero crossing of the P and displacement signals, the distortion and shifting of the P signal caused the control system to drive the hydraulic shaker away from the resonant frequency and attendant phase.

In a vibration generating system which is controlled by the power input (e.g., the rotational speed of an engine), a potential "runaway" situation exists, for when the maximum power input for a particular resonance is exceeded, the engine may speed up greatly, because the pipe can absorb less power at a frequency higher than resonance. The engine will have to speed up to the point where a value of power versus frequency of the engine equals a value of power versus frequency for the pipe. This problem will be explained below in more detail.

Figure 7:
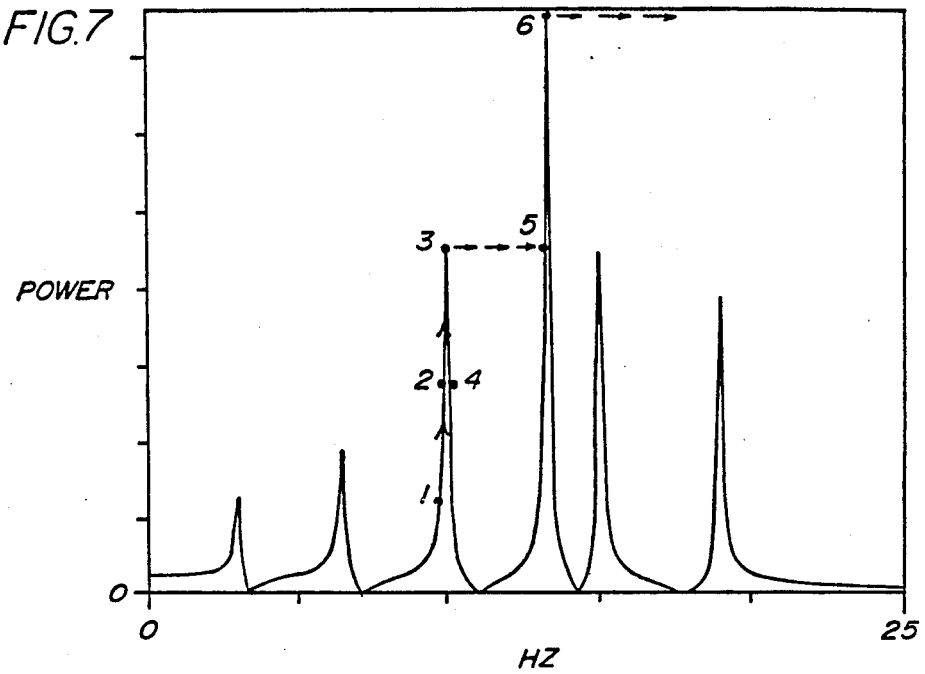
FIG. 7 is a power curve showing a series of peaks corresponding to different longitudinal modes of vibration of the pipe.

As an example, consider the power curve shown in FIG. 7, representing an undesirable prior-art system. The peaks in this power curve correspond to the different longitudinal modes of vibration of the pipe 11, with the higher-frequency modes having more nodes and antinodes. If the throttle of the drive unit or shaker 20 is originally set at 1, an increase in throttle would be required to move to 2; i.e., more power is required to drive the pipe 11 closer to the resonant frequency at 3. If the system is driven at exactly the resonant frequency corresponding to point 3, a small perturbation would cause the frequency to jump to point 5, since 4 is at a power level lower than 3. If the power delivered to the system at 3 is not sufficient for the purpose, and the throttle is then increased to 6, a small increase in throttle would cause a rapid increase in driving frequency, with the possibility of attendant damage. The danger of this runaway condition causes the operator to run such a vibrator at a power level below the maximum amount (5 instead of 6).

Operating the system at point 5 instead of point 6 not only reduces the amount of power applied to the members 11 and 13 but also results in the system not being operated at resonance. Point 6, or the peak of the power curve, is the resonant state of the elastic member. At resonance the spring force in the drill string is equal in magnitude and opposite in direction to the inertial force in the frill string, thereby canceling these reactive forces. The remaining dynamic force is a dissipative force caused by friction holding the liner. This force is proportional to the velocity. Operating the system at a point on the power curve other than at resonance results in producing large forces in the system—larger than the dissipative force, which greatly increase the stress in the elastic member (i.e. drill pipe) and the vibrator. This large harmful force can overstress parts in the system and cause destructive failure.

In contrast, a servo-hydraulic system 20 such as is used in this invention holds the frequency constant, and avoids this problem. Indeed one can increase the usable power level. The frequency controlled servo-hydraulic system operates as shown in FIG. 8.

Figure 8:
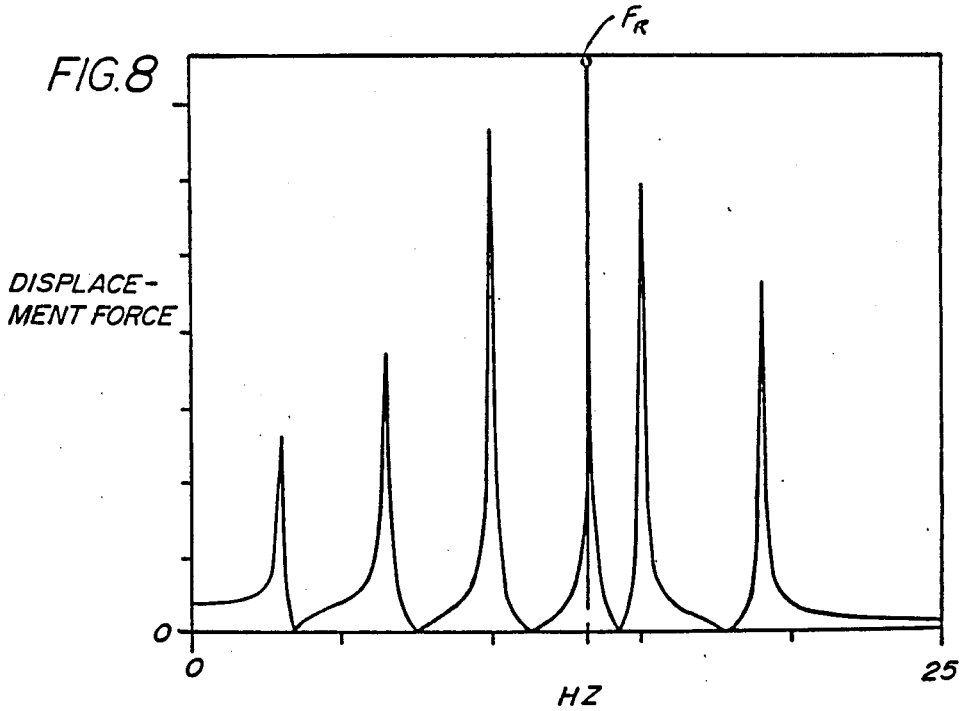
FIG. 8 is a similar view of the compliance or frequency-response curve for the drill string to which the power curve of FIG. 7 is applied.

FIG. 8 shows the compliance of frequency-response function for the longitudinal modes of vibration of the drill string 11. It represents the ratio of dynamic longitudinal displacement of a point on the pipe 11 to an input force. The servo-hydraulic system 50 is operated by choosing an appropriate resonant frequency, such as fr (see FIG. 8), and increasing the force to the level needed. An increase in force input by the hydraulic cylinder in this system increases only the vibratory amplitude in the pipe 11, not the frequency or the speed of operation. This is apparent by realizing that the operating speed is fixed at the resonant frequency by the feedback servo, as opposed to a system controlled by the power input. This feature allows the use of the accumulator 30 as a transient power booster, and this use greatly enhances the effectiveness of the system. Moreover, the servo hydraulic system 50 never excites the harmful modes of vibration, which can excite the derrick enough to damage the ancillary equipment.

The curve in FIG. 8 is essentially independent of power level, consequently it can be determined at a very low, non-harmful level. Indeed, this is accomplished prior to applying enough power to accomplish the desired purpose. The modes which involve excessive and damaging levels of vibration of the derrick and ancillary equipment are identified either experimentally or with the aid of a computer, at a power level which is safe. For example, an accelerometer 85 placed atop the reaction mass 21 can be used to indicate undue vibration and thereby identify a harmful mode. This is not possible with a rotating mass system, because the power curve in FIG. 7 is unique to the particular system. This means that the harmful modes cannot be identified at low vibration (i.e., safe) levels, and the power at the particular mode being excited may be inadequate. In addition, the rotating mass exciter starts at some low frequency and is constrained to sweep through the harmful modes. The servo hydraulic system picks a useful mode, locks on to the mode and excites only that mode to a level required.

Vibratory loading may last only a short period of time, generally from one to five minutes. This allows the use of the hydraulic accumulator 30 to store the pressurized hydraulic fluid when the drill string 11 is not being excited, thereby greatly reducing the size of the hydraulic pump 80 required.

Modern servo-hydraulic systems are thus well suited to the present invention, because their long-stroke cylinders eliminate the problem of impedance-matching the vibrator 20 to the drill string 11. Impedance-matching of rotating mass shakers to the item being vibrated is a significant problem because the force output is proportional to the frequency squared, while the mass and radius of rotating eccentric mass type vibrators are usually fixed and cannot be changed readily. These factors are not a problem in hydraulic shakers.

A comparison of the different approaches will explain why: an eccentric mass shaker is fundamentally two counter rotating masses (2m) which are located at a radial distance r and rotated at an angular velocity (w).

The force produced by this action is:

$$F=2m\ r\ w^2 \sin wt.$$

In existing systems, the mass and radius are fixed, so that the driving force depends only on the square of the rotational speed. Since the force and speed are directly related, one cannot increase the force, if operating at or near the peak of a resonance, without risking a runaway situation, as described above. Each pipe or drill bit or liner 13 has its own dynamic characteristics, because the depth of the hole and the weight of the drill string 11 can vary greatly.

In the servo-hydraulic system used in this invention, the force and operating speed are independent; the applied force is related to the relative displacement of the piston and cylinder 25. Increasing the force while maintaining resonance is accomplished simply by a command to the servo-controller.

Another advantage of employing the hydraulic shaker 20 to excite the pipe is that the modal displacement at the end of the pipe is not significantly reduced, because the mass or inertia of this shaker 20 is much smaller than that of other types. For example, compare the hydraulic system of this invention with a rotating-mass system.

In the hydraulic system used in this invention, the only added moving mass is that of the springs 24, the junction plate 23 and the piston 26 of the hydraulic cylinder 28. This mass is negligible when compared to that of the pipe 11 which is being excited. Therefore deflection of the pipe end is not appreciably reduced. The only change required to increase the cyclic force is an increase in the hydraulic pressure applied to the cylinder 28.

In a rotating-mass system, the added mass is comprised (typically) of two counter-rotating masses, the support structure, and the moving part of the vibration isolator. The additional mass in the counter-rotating-mass system reduces deflection by a considerable amount, a difficult effect to overcome. Consideration of the driving force applied to the top end of the pipe will explain why this is so.

The total force that a rotating-mass shaker would apply to the end of the pipe 11 is $$F_T=2F=2mrw^2-2ma$$

where

F=the force applied by each mass m.
m=mass of each of the two counter-rotating masses
a=acceleration of those masses
r=radius of rotation
w=angular velocity.

As explained previously, one particular mode is optimum because of impedance-matching considerations. This fact fixed the frequency of excitation (w). In order to increase the force either the mass or its radius must be increased. Stress levels in the structure holding the mass quickly exceed the yield stress if the radius is increased very much. Increasing the mass increases the term −2ma, which reduces the modal displacement of the pipe end. The resultant reduction of the modal displacement requires more applied force, thus creating a circular situation which yields diminishing improvements in performance.

The servo-controlled hydraulic assembly 25 can be driven by a broad range of hydraulic-pressure waveforms, in order to achieve maximum efficiency. Variations in the geologic formations in which liners, casings, pump etc. are lodged may require different strategies. In general, the winning strategy is determined by trial and error during the process.

OPERATION PROCEDURE

The first step in the process involves attaching the elastic steel pipe 11 or rod to the piece to be removed. This is accomplished by inserting the "fishing tool" 18 to the inside of the casing or liner 13. Pumps and drill bits already have a drill or pipe string 11 attached. Next, the vibrator 20 is attached to the free end of the pipe or drill rod 11, and an upward load is applied by the lifting block 16.

The hydraulic pump 80 may then be started and the accumulator 30 brought to working pressure (3000 p.s.i.). When the hydraulic system is actuated, it is driven at an appropriate resonant frequency which assures that the drill pipe 11 is maximally excited.

To those skilled in the art to which this invention relates, many changes in construction and widely differing embodiments and applications of the invention will suggest themselves without departing from the spirit and scope of the invention. The disclosures and the descriptions herein are purely illustrative and are not intended to be in any sense limiting.

What is claimed is:

1. A method for improving the production of oil from appropriate wells, comprising, attaching the lower end of an elastic steel column to the upper end of a liner, the upper end of said column extending to the top of the well and thereabove, attaching said upper end of said column to a reaction mass vertically thereabove through vertically mounted compression spring means and, in parallel therewith, a vertically mounted servo-controlled hydraulic cylinder-piston assembly, applying a substantially constant upward load to said reactions mass.

reciprocating the piston of said hydraulic cylinder under servo control to apply vertical vibration to the upper end of said column with resultant vertical displacement of the upper end of the column and developing a displacement signal therefrom, while developing an electrical, pressure-differential signal corresponding to the pressure across said cylinder-piston assembly, adjusting said vertical vibration through said servo control in accordance with said displacement signal and said pressure differential signal, to seek and find an appropriate resonant frequency for said column in the range of 5 Hz to 25 Hz, and maintaining said frequency at resonance.

2. The method of claim 1 wherein said step of maintaining said frequency at resonance includes keeping the displacement signal and pressure differential at a phase difference of approximately 90°.

3. The method of claim 2, including controlling the lateral modes of vibration of said elastic steel column by selecting a static operating tension which moves the lateral modes away from the operating frequency, so that drill-pipe protectors are not required and so that the time required to complete the stimulation process is therefore reduced.

4. The method of claim 1 in which said reciprocating step comprises testing a selected resonant frequency under low force input conditions, determining whether that frequency is liable to result in damage from excess vibration at a higher force input corresponding to a resonance peak or is very unlikely to result in such damage, applying the higher force to raise the vibration to a resonance peak only if it is very unlikely to result in such damage, and otherwise going to a different selected resonant frequency and testing and determining as above until a resonant frequency suitable for application of said higher force is determined.

5. The method of claim 4, wherein the determining step includes sensing the acceleration of said reaction mass and whether it indicates significant movement of said reaction mass, or not, said higher force being applied only if there is no significant movement of said reaction mass.

6. The method of claim 1 wherein said reciprocating step comprises scanning the spectrum of resonant frequencies at low force input, determining which resonant frequencies are harmful modes, liable to result in damage from excess vibration at higher force inputs needed to raise the vibration to a resonance peak, and which resonant frequencies are safe, very unlikely to result in such damage, selecting a safe resonant frequency, and increasing the force input to an effective amount.

7. The method of claim 6, wherein the determining step includes sensing the acceleration of said reaction mass and whether it indicates significant movement of said reaction mass or not, said higher force being applied only if there is no significant movement of said reaction mass.

8. A method for enhancing the production of oil from a suitable old oil well, comprising, attaching the lower end of an elastic steel column to the upper end of a liner, the upper end of said column extending to the top of the well and thereabove, attaching said upper end of said column through an accelerometer to a reaction mass vertically thereabove through vertically mounted compression spring means and, in parallel therewith, a vertically mounted servo-controlled hydraulic cylinder-piston assembly, applying a substantially constant upward load to said reaction mass, reciprocating the piston of said hydraulic cylinder under servo control to apply vertical vibration to the upper end of said column, measuring the instantaneous acceleration of said column with reference to the stationary walls of the well and developing an electrical acceleration signal thereby, electrically double-integrating the acceleration signal, filtering the doubly integrated signal to attenuate its low frequency noise, thereby giving a displacement signal, simultaneously detecting the instantaneous pressure across the hydraulic cylinder-piston assembly and developing an electrical pressure-difference signal therefrom, detecting the relative phase between said pressure difference signal and said displacement signal and generating an electrical signal proportional to the relative phase, being zero when the phase is 90°, which is the condition at resonance, electrically integrating the relative phase signal to produce a voltage control signal, and applying said voltage control signal to drive a voltage-controlled oscillator to cause the output of that oscillator to maintain said resonance.

9. Apparatus for enhancing oil recovery from suitable wells where an upper end of a liner has been attached to the lower end of an elastic steel column, the upper end of said column extending to the top of the well and thereabove, comprising a reaction mass vertically above said column, vertically mounted compression spring means and, in parallel therewith, a vertically mounted hydraulic cylinder-piston assembly connecting said reaction mass to said column, an accelerometer connected to the upper end of said column and sensitive to the vertical movement thereof.

support means for supporting and applying a constant upward load to said reaction mass, servo-control means connected to said hydraulic cylinder-piston assembly for reciprocating the piston of said assembly under servo control to apply vertical vibration to the upper end of said column, and feedback means connected to said accelerometer and to said servo-control means and employing the phase difference between a displacement signal from said sensing means and a pressure difference signal from said cylinder-piston assembly for adjusting said servo control to cause said assembly to seek and maintain an appropriate resonant frequency for said column in the range of 5 Hz to 25 Hz.

10. The apparatus of claim 9 wherein said feedback means includes means for maintaining a phase difference of approximately 90° between said displacement signal and said pressure difference signal.

11. The apparatus of claim 9 wherein said feedback means comprises a double integrator electrically connected to said accelerometer to develop a displacement signal, a pressure-differential transducer connected to the opposite sides of said piston and delivering a pressure-difference signal, and resonant controller means for receiving said displacement signal and said pressure-difference signal and for controlling frequency of delivery of pressurized fluid from said servo control means to said hydraulic-piston assembly on each side of said piston such as to maintain a phase difference of approximately 90° between the two said signals.

12. The apparatus of claim 9 having scanning means for scanning the resonant frequencies available at low force input, indicating means for determining which said frequencies are likely to be harmful and which ones are safe upon increasing the force input to a valve producing peak resonance, and force increasing means for increasing said force input only at a safe such frequency.

13. Apparatus for enhancing oil recovery from suitable wells in which the upper end of a liner has been attached the lower end of an elastic steel column, the upper end of said column extending to the top of the well and thereabove, comprising a reaction mass vertically above said column, vertically mounted compression spring means and, in parallel therewith, a vertically mounted hydraulic cylinder-piston assembly connecting said reaction mass to said column through an accelerometer, support means for supporting and applying a constant upward load to said reaction mass, servo-control means connected to said hydraulic cylinder-piston assembly for reciprocating the piston of said assembly under servo control to apply vertical vibration to the upper end of said column, and feedback means connected to said accelerometer and to said servo-control means and including measuring means for measuring the acceleration of said column with reference to the stationary walls of the well, first signal generating means for developing an electrical acceleration signal corresponding to said acceleration, double integrator means for electrically double-integrating the acceleration signal, filter means to filtering the doubly integrated signal to attenuate its low frequency noise, thereby giving a displacement signal, pressure sensing means for detecting the pressure across the hydraulic cylinder-piston assembly second signal generating means for developing an electrical, pressure-difference signal from said pressure, detecting means for detecting the relative phase between said pressure difference signal and said displacement signal, third signal generating means for generating an electrical signal proportional to the relative phase, said signal being zero when the phase is 90° which is the condition at resonance, single integrating means for electrically integrating the relative phase signal to produce a voltage control signal, and driving means for applying said voltage control signal to drive a voltage-controlled oscillator to cause the output of that oscillator to maintain said resonance at an appropriate resonant frequency for said column in the range of 5 Hz to 25 Hz.

* * * * *